US008646304B2

(12) United States Patent
Friesen et al.

(10) Patent No.: US 8,646,304 B2
(45) Date of Patent: Feb. 11, 2014

(54) GRAIN BIN FLOOR PANEL

(76) Inventors: Johnny Richard Friesen, Winkler (CA); Peter W. Friesen, Winkler (CA)

( * ) Notice: Subject to any disclaimer, the term of this patent is extended or adjusted under 35 U.S.C. 154(b) by 251 days.

(21) Appl. No.: 13/037,456

(22) Filed: Mar. 1, 2011

(65) Prior Publication Data

US 2012/0222377 A1 Sep. 6, 2012

(51) Int. Cl.
*B21D 31/00* (2006.01)
*B21B 15/00* (2006.01)

(52) U.S. Cl.
USPC ..... 72/379.2; 72/177

(58) Field of Classification Search
USPC ..... 72/181, 176, 177, 379.2, 379.6; 29/897, 29/897.3, 897.32
See application file for complete search history.

(56) References Cited

U.S. PATENT DOCUMENTS

| | | | | |
|---|---|---|---|---|
| 4,418,558 | A | 12/1983 | Simmons | |
| 5,417,028 | A * | 5/1995 | Meyer | 52/846 |
| 5,732,582 | A * | 3/1998 | Knudson | 72/181 |
| 7,107,807 | B2 * | 9/2006 | Ingvarsson et al. | 72/181 |
| 7,310,919 | B2 | 12/2007 | Grossman et al. | |
| 7,487,621 | B2 | 2/2009 | Grossman et al. | |
| 2009/0113842 | A1 | 5/2009 | Grossman et al. | |

* cited by examiner

*Primary Examiner* — Teresa M Ekiert
(74) *Attorney, Agent, or Firm* — Ryan W. Dupuis; Kyle R. Scutlerthwaite; Ade & Company Inc.

(57) ABSTRACT

In a grain bin floor panel having first and second floor surface extending outwardly from a central support leg to respective first and second side support legs, the central support leg includes first and second upright portions and a lower portion connected between respective lower ends of the first and second upright portion. The first and second upright portions are connected to respective ones of the first and second floor surfaces at the upper ends of the upright portions and are spaced apart from one another at respective lower ends. The lower portion is generally concave such that the lower ends of the first and second upright portions together with the lower portion forms a concave quadrilateral.

10 Claims, 4 Drawing Sheets

GRAIN BIN FLOOR PANEL

FIELD OF THE INVENTION

The present invention relates to a floor panel formed from sheet metal for use in forming a grain bin floor, and more particularly the present invention relates to a floor panel comprising perforated floor surfaces supported by support legs to define plenums below the floor surfaces for ventilating grain supported on the floor surfaces.

BACKGROUND

Floor panels formed of sheet metal are known for use in grain bins in various forms. One example is disclosed in U.S. Pat. No. 4,418,558 to Simmons. In this instance, sheet metal is perforated and bent using roll forming machinery to form a floor member comprising a raised perforated floor surface and depending legs along each side thereof to support the perforated portion above a plenum space therebelow. Accordingly ventilation air can be circulated through the plenum space and upwardly through the perforations to prevent spoilage of the grain supported above the floor panels in the grain bin.

To simplify the installation process while maintaining considerable strength in the floor for larger grain bins and larger volumes of grain supported on the floor panels, U.S. Pat. No. 7,310,919 by Grossman et al discloses a flooring system in which each flooring panel is formed to also include a central leg between the two side legs so that the raised perforated portion comprises two floor surfaces spanning outwardly from the center leg to the respective side legs. This permits a larger floor panel to be formed while maintaining equal or greater strength than prior floor panels as described above with regard to Simmons. The more complex shape of the floor panel when forming a central support however is more difficult to form using roll forming techniques. More particularly the increased complexity makes it more difficult to keep the panel straight as it passes through the roll former. When the panels are twisted or otherwise not straight, the floor panels are much more difficult to assemble into a finished floor in the grain bin.

Examples of supports upon which the floor panels can be supported are described in U.S. Pat. No. 7,487,621 and US Publication 2009/0113842, both to Grossman et al.

SUMMARY OF THE INVENTION

According to one aspect of the invention there is provided a grain bin floor panel comprising:

a central support leg extending in a longitudinal direction between opposing ends of the panel;

a first side support leg and a second side support leg extending in the longitudinal direction and being spaced laterally outward from opposing sides of the central support leg;

a first floor surface connected between the first side support leg and the central support leg and including ventilating perforations formed therein; and a second floor surface connected between the second side support leg and the central support leg and including ventilating perforations formed therein;

the first floor surface, the second floor surface, the first side support leg, the second side support leg, and the central support leg being formed of a bent unitary piece of sheet metal; and the central support leg comprising:

first and second upright portions connected to respective ones of the first floor surface and the second floor surface at respective upper ends of the upright portions and spaced apart from one another at respective lower ends of the upright portions; and a lower portion connected between respective lower ends of the first and second upright portions;

the lower portion being generally concave such that a central portion of the lower portion is raised upwardly in relation to the lower ends of the first and second upright portions.

By providing a central support leg having a lower portion which is concave, the concave contributes to keeping the central support leg straighter. As the central support leg is formed at an early stage in the roll forming process, keeping the central leg straighter due to the concave also better guides the sheet metal through a roll forming process to ensure that the finished panel is straighter and stronger than prior art configurations. The concave lower portion also causes the bottom apexes of the generally triangular area of the central leg support to have narrower interior angles which increases the strength thereof considerably. By maintaining a relatively flat angle in the concave lower portion, the lower portion maintains strength and tension between the lower ends of the upright portions of the central leg support to maintain the standing strength of the central leg support contrary to the expectations of ordinary skilled workers in the art.

Preferably the lower portion comprises two inclined bottom portions joined by a central bend extending in the longitudinal direction such that the two inclined bottom portions and at least a portion of each upright portion form a concave quadrilateral. The two inclined bottom portions may be inclined relative to one another at an angle in the range of 140 to 170 degrees, and more preferably at an angle of approximately 150 degrees. Each inclined bottom portion may also be inclined relative to the respective upright portion connected thereto at an angle in the range of 40 to 50 degrees, and more preferably at an angle of approximately 45 degrees.

When each upright portion includes a vertical leg portion adjacent the top end and an inclined leg portion extending downwardly and outwardly from the opposing upright portion to the lower end, the vertical leg portions are preferably joined by attachment portions which are all commonly located at longitudinally spaced positions on the first upright portion and which are folded into respective apertures which are all commonly located at longitudinally spaced positions on the second upright portion.

According to a second aspect of the present invention there is provided a method of forming a grain bin floor panel comprising:

providing a unitary piece of sheet metal;

passing the unitary piece of sheet metal through a roll former comprising a plurality of rollers arranged to progressively bend the sheet metal into a floor panel structure comprising:

a central support leg extending in a longitudinal direction between opposing ends of the panel;

a first side support leg and a second side support leg extending in the longitudinal direction and being spaced laterally outward from opposing sides of the central support leg;

a first floor surface connected between the first side support leg and the central support leg and including ventilating perforations formed therein; and a second floor surface connected between the second side support leg and the central support leg and including ventilating perforations formed therein;

the first floor surface, the second floor surface, the first side support leg, the second side support leg, and the central support leg being formed of a bent unitary piece of sheet metal; and the central support leg comprising:

first and second upright portions connected to respective ones of the first floor surface and the second floor surface at respective upper ends of the upright portions and spaced apart from one another at respective lower ends of the upright portions; and a lower portion connected between respective lower ends of the first and second upright portions;

forming the lower portion to be concave such that a central portion of the lower portion is raised upwardly in relation to the lower ends of the first and second upright portions at an intermediate stage of the roll former.

Preferably the method also includes:

forming each upright portion to include a vertical leg portion adjacent the top end and an inclined leg portion extending downwardly and outwardly from the opposing upright portion to the lower end; and joining the vertical leg portions subsequent to forming the lower portion to be concave.

The vertical leg portions may be joined by folding attachment portions commonly located at longitudinally spaced positions on the first upright portion through respective apertures which are all commonly located at longitudinally spaced positions on the second upright portion. Preferably the attachment portions on the first upright portion and the respective apertures in the second upright portion are formed simultaneously by a punching tool which is punched through the vertical leg portions.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
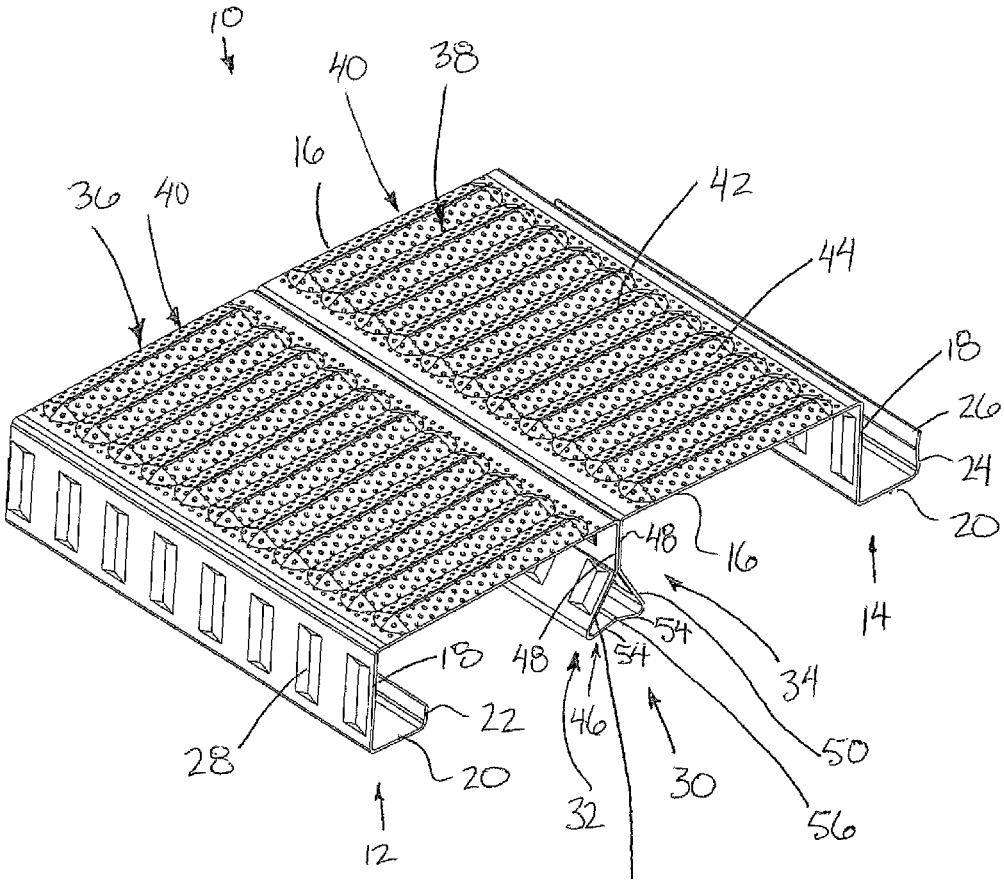
FIG. 1 is a perspective view of a portion of one of the floor panels.
Figure 2:
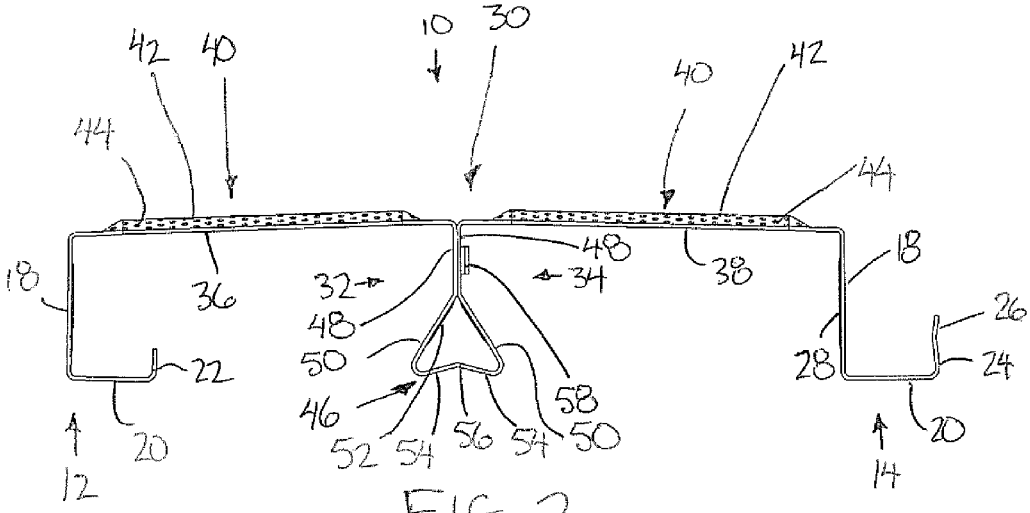
FIG. 2 is an end elevational view of the floor panel.
Figure 3:
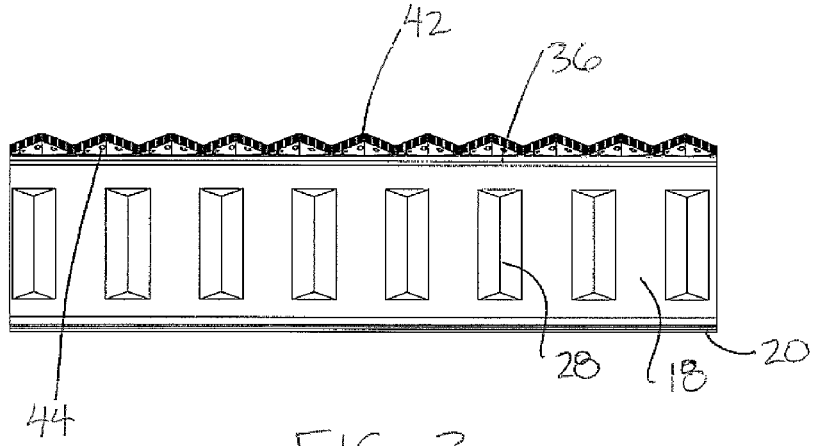
FIG. 3 is a side elevational view of the floor panel.
Figure 4:
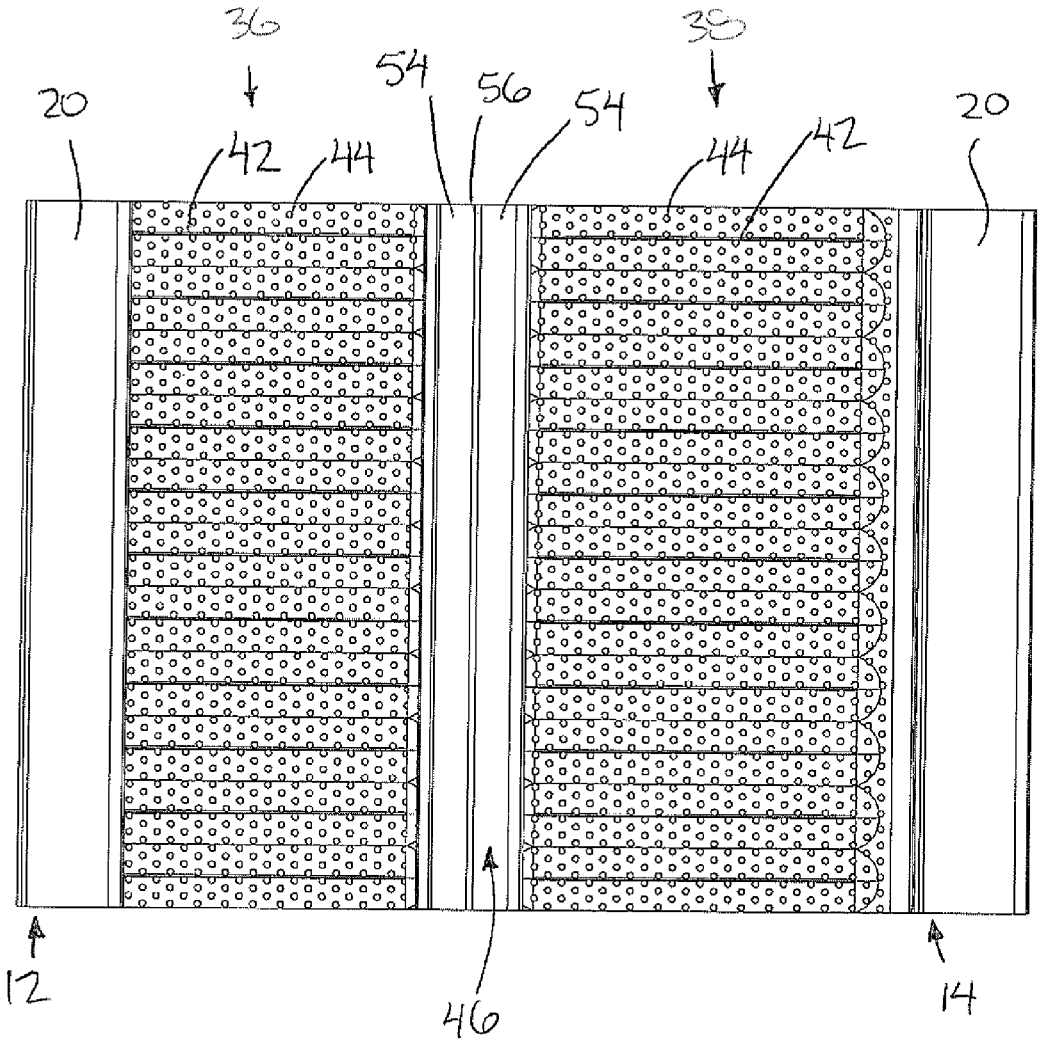
FIG. 4 is a top plan view of the floor panel.
Figure 5:
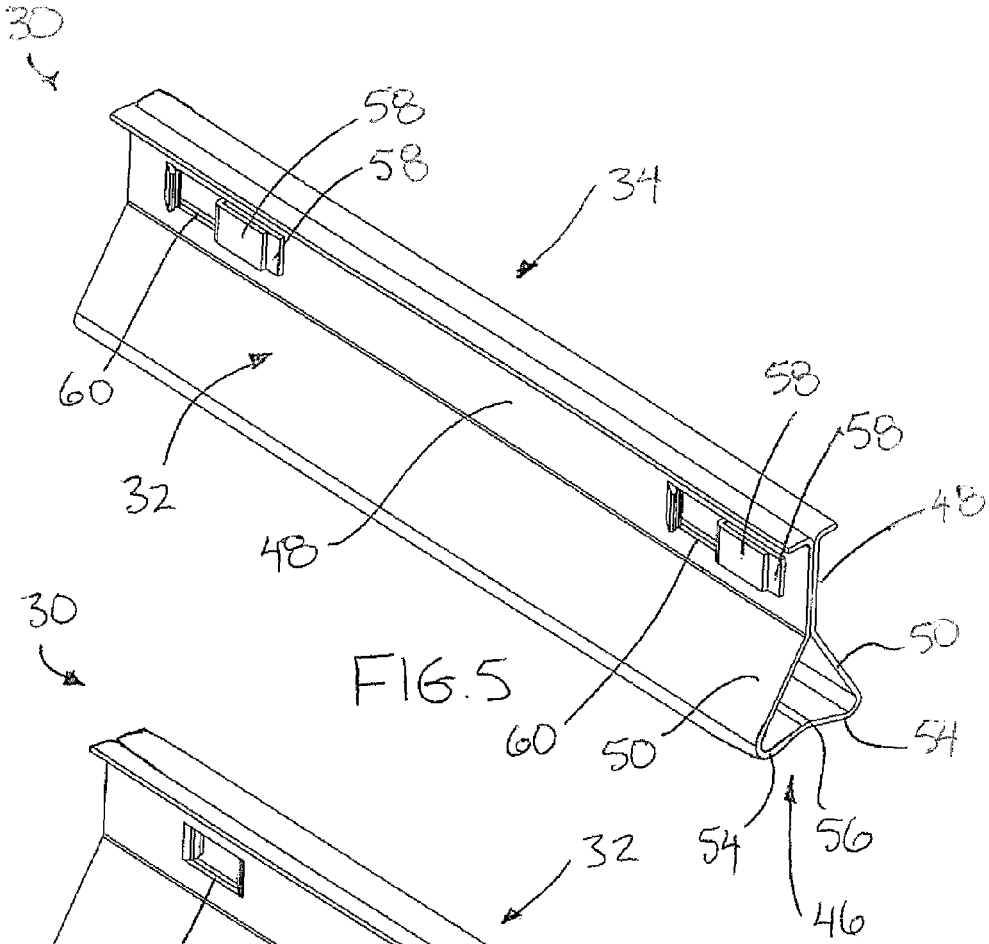
FIG. 5 is a partly sectional perspective view of the central support leg separated from the floor surfaces to illustrate connection between the upright portions of the central support leg.
Figure 6:
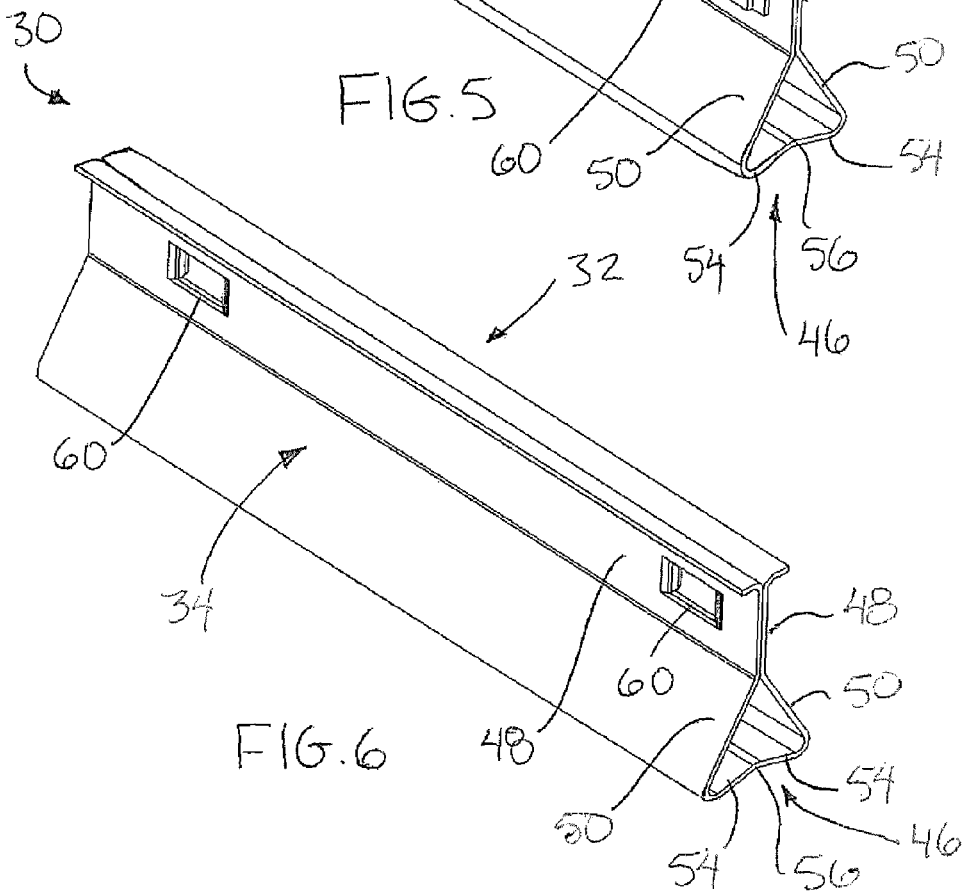
FIG. 6 is a perspective view of the central support leg as in FIG. 5 but from the opposing side.

Referring to the accompanying figures, there is illustrated a grain bin floor panel generally indicated by reference numeral 10. The floor panel 10 is used in forming a false floor in a grain bin for supporting grain thereon in the bin and for defining a plenum space therebelow which allows ventilation therethrough in a sufficient amount to dry the grain or prevent grain spoilage.

The floor panels are typically supported on a series of floor supports, for example similar to those described in US Publication 2009/0113842 by Grossman et al. In the assembled configuration, the floor panels are interconnected side by side in rows with several panels being abutted end to end within each row to fully cover the floor of the grain bin.

Each floor panel 10 is typically formed of a single unitary piece of sheet metal which is punched, bent and folded in progressive stages through a continuous roll forming device comprised of rollers and punching tools which successively engage the piece of sheet metal.

Each finished panel generally includes a first side support leg 12 and a second side support leg 14 spanning in a longitudinal direction of the panel between two opposing ends 16 such that the side support legs are parallel and spaced apart along opposing sides of the panel. Each side support leg generally includes a vertical flange 18 spanning a full height of the panel between top and bottom ends and a foot 20 at the bottom end of the vertical flange. The foot generally comprises a horizontal flange. At the first side support leg, the foot 20 extends inwardly towards the opposing side support leg. An inner edge flange 22 extends upwardly from the inner end of the foot 20 to strengthen the inner edge of the foot.

At the second side support leg, the foot 20 extends outward away from the opposing side support leg such that the second foot 20 is arranged to be overlapped by the first foot of an adjacent panel of similar configuration when the panels are mounted adjacent one another in the finished floor. The foot of the second side support leg 14 includes an outer edge flange 24 extending upwardly from the outer edge thereof at a slight inward angle so as to overlap and retain the inner edge flange of the foot and an adjacent panel received therein in the mounted position. The outer edge flange 24 also includes an upper portion 26 which is flared upwardly at an outward inclination to more easily guide insertion of the foot of an adjacent panel into the space between the second side support leg and the respective outer edge flange 24. Each of the vertical flanges 18 of the side support legs includes a plurality of crimps 28 formed therein at longitudinally spaced positions in which each crimp comprises one or more vertical fold edges to stiffen the side support leg.

The panel further comprises a central support leg 30 also extending in the longitudinal direction between opposing ends of the panel. The central support leg is parallel to the two side support legs and is centrally located therebetween such that the two side support legs are spaced laterally outwardly from opposing sides of the central leg support by a similar distance.

The central support leg 30 includes a first upright portion 32 and a second upright portion 34 spanning the full height of the panel. The first upright portion 32 is integrally formed with a first floor surface 36 which spans laterally between the central support leg and the first side support leg at the top of the floor panel by connecting between the upper ends of the respective legs. Similarly a second floor surface 38 is integrally connected between upper ends of the second upright portion 34 of the central support leg and the respective upper end of the second side support leg at the top of the panel. The upper ends of the first and second upright portions of the central support leg are directly adjacent one another such that the inner edges of the first and second floor surfaces are abutted with one another and the first and second floor surfaces are substantially in a common plane at the top of the floor panel so that the first and second floor surfaces are along side one another in the longitudinal direction. The outer edges of the floor surfaces are formed integrally with and connected with the respective side legs.

Each of the first and second floor surfaces includes a central portion 40 which is crimped to define a plurality of laterally extending folding edges 42 spanning substantially the full width in the lateral direction perpendicularly to the longitudinal direction of the panel. Perforations 44 are also provided in the central portion which are sufficiently small to prevent passage of grain particles therethrough while being sufficient in number and sufficiently large to allow for proper ventilation of grain supported thereon in the grain bin so as to prevent spoilage of the grain.

The first and second upright portions of the central support leg are joined together at the upper end thereof where the upright portions are integral with the respective floor surfaces, however the lower ends of the upright portions are spaced apart with one another at the bottom of the floor panel so as to be joined together by a lower portion 46 of the central support leg which extends generally laterally between the lower ends of the two upright portions.

More particularly, each upright portion includes a vertical leg portion 48 at the upper end. The vertical leg portions are abutted against one another so as to be parallel to one another and so as to permit joining of the two vertical leg portions together by suitable joining techniques as described in further detail below.

Each upright portion further includes an inclined leg portion 50 extending downwardly from the respective vertical leg portion at an outward inclination so that the inclined leg portions are adjacent one another at the upper ends but diverge from one another towards the bottom ends joined integrally with the lower portion 46 connected therebetween. The inclined leg portions 50 include a plurality of crimps 52 formed at longitudinally spaced positions therealong so as to comprise generally vertical folding edges which stiffen the inclined leg portions.

The lower portion 46 of the central support leg comprises two inclined bottom portions 54 which are each generally flat and which each extend in the longitudinal direction the full length of the panel. The inclined bottom portions extend upwardly at an inward inclination from the lower ends of the first and second upright portions to a central apex 56 which is laterally centered between the inclined leg portions and which is spaced above and raised upwardly from the two lower ends of the upright portions. Each inclined bottom portion 54 joins the respective inclined leg portion 50 at an interior angle of approximately 45 degrees. The apex has a bottom angle near 150 degrees between the two inclined bottom portions 54 such that the lower portion of the central support leg defines a concave quadrilateral in shape. The apex comprises a central bend or fold in the sheet metal which extends in the longitudinal direction along the full length of the floor panel for both stiffening the lower portion 46 as well as stiffening the connection between the lower portion and the inclined leg portions 50 due to the sharper interior angle thereof.

As described above, the floor panel is formed with a roll forming machine in which several roll forming stages are performed in continuous succession. Typically, the central leg support is first formed including the concave shape of the lower portion prior to joining of the two vertical leg portions 48 together and prior to forming the side support legs in subsequent stages of the roll forming process. By forming the concave shape of the lower portion at an early or intermediate stage of the roll forming process, the central support leg can be stronger and maintained straighter for better alignment of the sheet metal through the subsequent roll forming stages to produce a considerably straighter finished panel than prior art attempts.

The vertical leg portions 48 are joined with one another by a suitable punching tool which is punched laterally through the two vertical leg portions 48. Prior to engagement with the punching tool, each of the vertical leg portions comprises a continuous span of sheet metal. Insertion of the punching tool through the two vertical leg portions abutted with one another simultaneously forms a U-shaped cut in the sheet metal in each of the leg portions to define a protrusion 58 on both of the vertical leg portions extending in a common lateral direction. More particularly, the protrusion 58 formed on the second upright portion 34 is pushed through the aperture 60 which remains in the first upright portion by formation of the respective protrusion 58 thereon. Accordingly both protrusions can be folded together in a generally U-shape which clamps the first upright portion between the second upright portion and the folded protrusions 58. A mating pair of protrusions 58 and corresponding apertures receiving the protrusions therethrough are formed at longitudinally spaced positions along the vertical leg portion to suitably join the vertical leg portions together.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method of forming a grain bin floor panel comprising:

a) providing a unitary piece of sheet metal;

b) providing a roll former comprising a plurality of rollers and at least one joining tool arranged to progressively form the unitary piece of sheet metal into a floor panel structure;

c) using the rollers of the roll former, forming a central support leg of the floor panel structure to extend in a longitudinal direction between opposing ends of the floor panel structure by:

i) folding the unitary piece of sheet metal to define first and second upright portions having upper ends and lower ends and a lower portion connected between the lower ends of the first and second upright portions which are spaced apart from one another; and ii) bending the lower portion to be concave such that a central portion of the lower portion is raised upwardly in relation to the lower ends of the first and second upright portions;

d) using said at least one joining tool, joining the first and second upright portions to one another in proximity to the upper ends;

e) using the rollers of the roll former, folding the sheet metal to define a first floor surface, a second floor surface, a first side support leg and a second side support leg of the floor panel structure wherein:

i) the first side support leg and the second side support leg extend in the longitudinal direction and are spaced laterally outward from opposing sides of the central support leg;

ii) the first floor surface is connected between the first side support leg and the upper end of the first upright portion of the central support leg; and iii) the second floor surface is connected between the second side support leg and the upper end of the second upright portion of the central support leg; and f) providing ventilating perforations in the first floor surface and the second floor surface;

wherein the lower portion of the central support leg is bent to be concave prior to defining at least one of the first floor surface, the second floor surface, the first side support leg and the second side support leg of the floor panel structure.

2. The method according to claim 1 including bending the sheet metal such that each upright portion includes a vertical leg portion adjacent the top end and an inclined leg portion extending downwardly and outwardly from the opposing upright portion to the lower end; and joining the first and second upright portions by joining the vertical leg portions subsequent to forming the lower portion to be concave.

3. The method according to claim 1 including:

bending the sheet metal such that each upright portion includes a vertical leg portion adjacent the top end and an inclined leg portion extending downwardly and outwardly from the opposing upright portion to the lower end; and joining the first and second upright portions by joining the vertical leg portions by folding attachment portions commonly located at longitudinally spaced positions on the first upright portion through respective apertures which are all commonly located at longitudinally spaced positions on the second upright portion.

4. The method according to claim 3 wherein said at least one joining tool comprises a punching tool, the method including simultaneously forming the attachment portions on the first upright portion and the respective apertures in the second upright portion using the punching tool punching tool by punching through the vertical leg portions.

5. The method according to claim 1 including bending the lower portion to be concave such that the lower portion comprises two inclined bottom portions joined by a central bend extending in the longitudinal direction.

6. The method according to claim 1 including bending the lower portion to be concave such that the two inclined bottom portions and at least a portion of each upright portion form a concave quadrilateral.

7. The method according to claim 1 including bending the lower portion to be concave such that the two inclined bottom portions are inclined relative to one another at an angle in the range of 140 to 170 degrees.

8. The method according to claim 1 including bending the lower portion to be concave such that the two inclined bottom portions are inclined relative to one another at an angle of approximately 150 degrees.

9. The method according to claim 1 including bending the lower portion to be concave such that each inclined bottom portion is inclined relative to the respective upright portion connected thereto at an angle in the range of 40 to 50 degrees.

10. The method according to claim 1 including bending the lower portion to be concave such that each inclined bottom portion is inclined relative to the respective upright portion connected thereto at an angle of approximately 45 degrees.

* * * * *